United States Patent [19]

Fischer et al.

[11] Patent Number: 5,024,161

[45] Date of Patent: Jun. 18, 1991

[54] MOLDING APPARATUS

[75] Inventors: Kurt Fischer; Georges Louys, both of Schaffhausen, Switzerland

[73] Assignee: Georg Fischer AG, Schaffhausen, Switzerland

[21] Appl. No.: 149,975

[22] Filed: Jan. 26, 1988

Related U.S. Application Data

[63] Continuation of Ser. No. 14,094, Jan. 29, 1987, abandoned, which is a continuation of Ser. No. 748,739, Jun. 25, 1988, abandoned.

[30] Foreign Application Priority Data

Jun. 25, 1984 [CH] Switzerland ..... 3046/84

[51] Int. Cl.[5] ..... B22C 15/00

[52] U.S. Cl. ..... 164/149; 164/37

[58] Field of Search ..... 164/12, 15, 19, 37, 164/38, 169, 170, 171, 195, 200, 201, 202

[56] References Cited

U.S. PATENT DOCUMENTS

| | | | |
|---|---|---|---|
| 2,112,910 | 4/1938 | Jeffery | 164/38 |
| 2,665,461 | 1/1954 | Rodgers | 164/202 |
| 2,757,424 | 8/1956 | Daniel et al. | 164/195 |
| 2,847,736 | 8/1958 | Pulvermacher | 164/195 |
| 3,170,202 | 2/1965 | Huston et al. | 164/37 |
| 3,253,304 | 5/1966 | Hatch | 164/12 |
| 3,556,195 | 1/1971 | Lund | 164/201 |
| 3,659,642 | 5/1972 | Vasilkovsky et al. | 164/169 |
| 4,289,194 | 9/1981 | Uzaki et al. | 164/170 |
| 4,306,609 | 12/1981 | Fischer et al. | 164/37 |
| 4,436,141 | 3/1984 | Erana | 164/201 |
| 4,505,316 | 3/1985 | Tanner | 164/37 |
| 4,529,026 | 7/1985 | Kobel et al. | 164/37 |
| 4,538,664 | 9/1985 | Kobel et al. | 164/37 |
| 4,550,765 | 11/1985 | Fischer et al. | 164/194 |
| 4,565,233 | 1/1986 | Fischer et al. | 164/37 |
| 4,565,235 | 1/1986 | Fischer et al. | 164/37 |

FOREIGN PATENT DOCUMENTS

| | | | |
|---|---|---|---|
| 0017131 | 10/1980 | European Pat. Off. . | |
| 3202395 | 8/1982 | Fed. Rep. of Germany . | |
| 2844464 | 4/1984 | Fed. Rep. of Germany . | |
| 2443891 | 7/1980 | France . | |
| 47-40930 | 10/1972 | Japan | 164/169 |
| 55-133847 | 10/1980 | Japan . | |
| 55-141355 | 11/1980 | Japan . | |
| 55-147462 | 11/1980 | Japan . | |
| 55-56640 | 12/1980 | Japan | 164/12 |

OTHER PUBLICATIONS

Russian Casting Production, "Explosive Mould Compacting", No. 4, pp. 155 et seq., 1986.

George Fischer Foundry Systems, Inc., "Impact-Molding: A New Technique to Solve Old Problems," brochure.

Giesserei 67, "Economic Review", No. 20, pp. 662-663, 1980.

Giesserei 68, "New Impact Moulding Method for the Compaction of Claybonded Molding Materials", No. 20, pp. 603-610, 9/23/81.

George Fischer Foundry Systems, Inc., "Impact Moulding Process", brochure.

*Primary Examiner*—Richard K. Seidel

*Attorney, Agent, or Firm*—Marmorek, Guttman & Rubenstein

[57] ABSTRACT

A forming apparatus for the manufacture of casting molds made from sand or another moldable mixture by means of a pressure shock wave from a gaseous medium is proposed. The forming apparatus comprises a structural frame constructed from columns, cross beams, and longitudinal beams, a forming combination within the structural frame, and a pressure vessel for producing the pressure shock wave. The pressure vessel is located above the forming combination and is supported by the cross beams of the structural frame. The forming apparatus also includes a filling vessel containing a supply of sand or other moldable mixture for delivery to the forming combination. The filling vessel is located above the forming combination and is supported by the cross beams of the structural frame is such manner that the topmost edges of these cross beams lie in substantially the same plane as the bottom of the filling vessel. This arrangement results in the center of gravity of the apparatus lying within the range of the forming combination. With such a forming apparatus, the pressure vessel can be exchanged for other pressure vessels of even larger size without incurring major expenses.

12 Claims, 2 Drawing Sheets

MOLDING APPARATUS

This is a continuation of application Ser. No. 014,094, filed Jan. 29, 1987, now abandoned, which is a continuation of application Ser. No. 748,739 filed June 25, 1985 abandoned.

BACKGROUND OF THE INVENTION

The present invention relates to an apparatus for the manufacture of casting molds. More particularly, the present invention relates to an apparatus for the manufacture of casting molds by means of a pressure shock from a gaseous medium. The apparatus furthermore includes a pressure vessel or chamber, a filling vessel, and a forming combination that comprises a molding box arranged over a model plate with a filling frame disposed above it.

A series of molding devices have been known for the manufacture of sand forms for foundry purposes that work according to the principle of a pressure shock. It is evident that the individual parts of such an apparatus need to be surrounded by a structure such as a frame which bears the individual machine parts and receives the developing forces. There have been known embodiments with tall supporting columns, the upper transverse crossbeams of which constitute at the same time the topmost portions of the machine.

Such an embodiment may be satisfactory from an esthetic viewpoint, but it cannot satisfy the requirements for a casting apparatus in point of static stability, flexibility, adaptability to different applications, or manufacturing cost.

The present invention aims to present a satisfactory solution to the problem of simultaneously satisfying these requirements. In accordance with the present invention, an apparatus is provided which places no restriction on the height of the pressure vessel. Yet, at the same time, the proposed apparatus can be rebuilt at any time inexpensively with simple means and can be adapted to higher pressure vessels and sand filling vessels. By substantially reducing the weight of the structure, it is also possible to reduce the costs.

SUMMARY OF THE INVENTION

In accordance with the present invention, a forming apparatus for the manufacture of casting molds by means of a pressure shock from a gaseous medium is disclosed. The forming apparatus comprises a pressure vessel, a filling vessel, a forming combination, and a structural frame. The structural frame comprises a series of columns, cross beams, and longitudinal beams. The forming combination is located within the structural frame, while the filling vessel and the pressure vessel are supported by the cross beams of the structural frame. These components are arranged so that the topmost edges of the upper cross beams lie in substantially the same plane as the bottom of the filling vessel.

As a result, the center of gravity of the entire structure can be located within the forming combination. In addition, the filling and pressure vessels can be exchanged without rebuilding the entire structure.

In a preferred embodiment, the cross beams are provided with guide rails along their upper edges, and the filling and pressure vessels are displaceable along the guide rails.

DETAILED DESCRIPTION OF THE DRAWINGS

Figure 1:
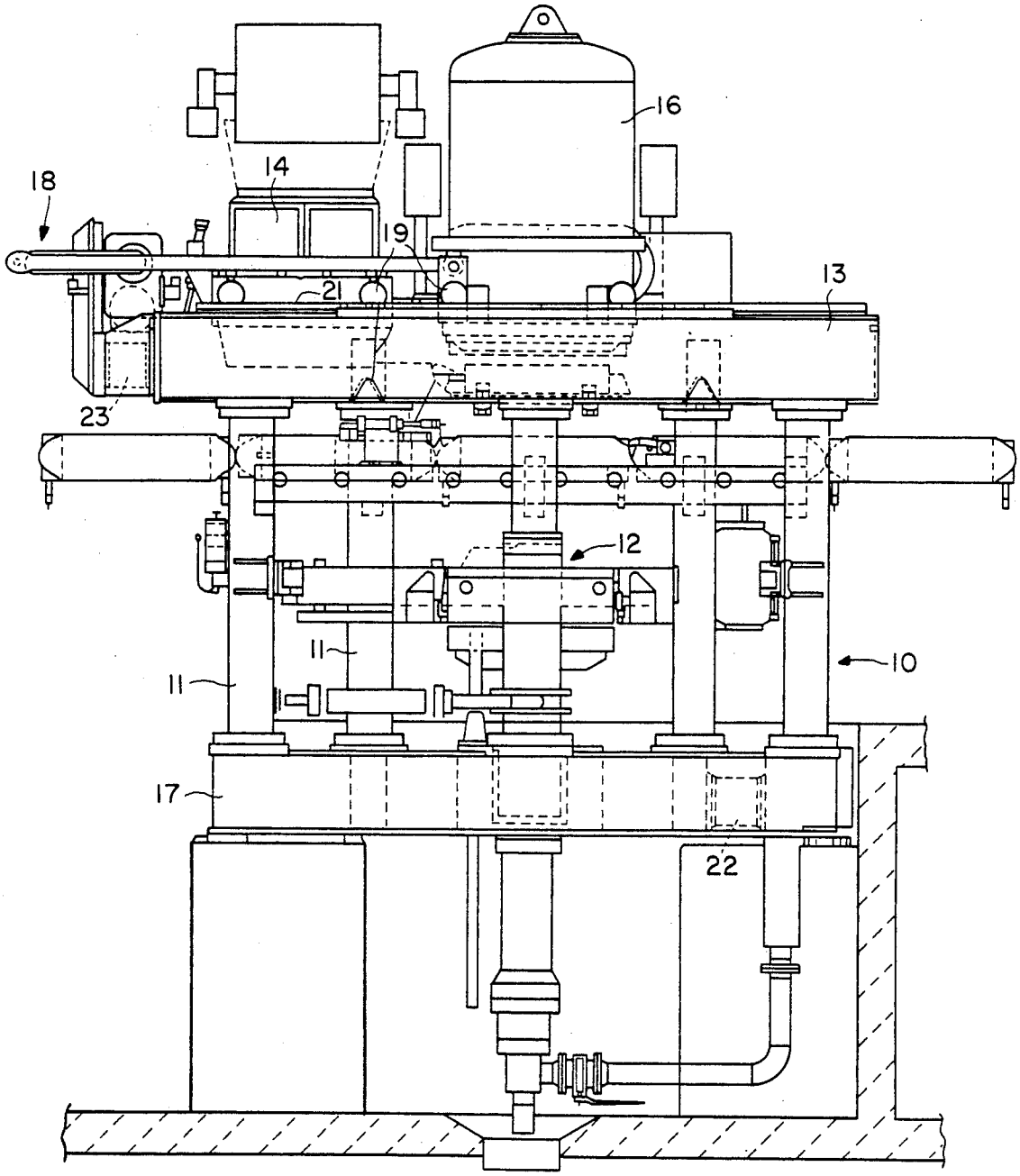
FIG. 1 is a sectional view of one embodiment of the apparatus of the present invention.
Figure 2:
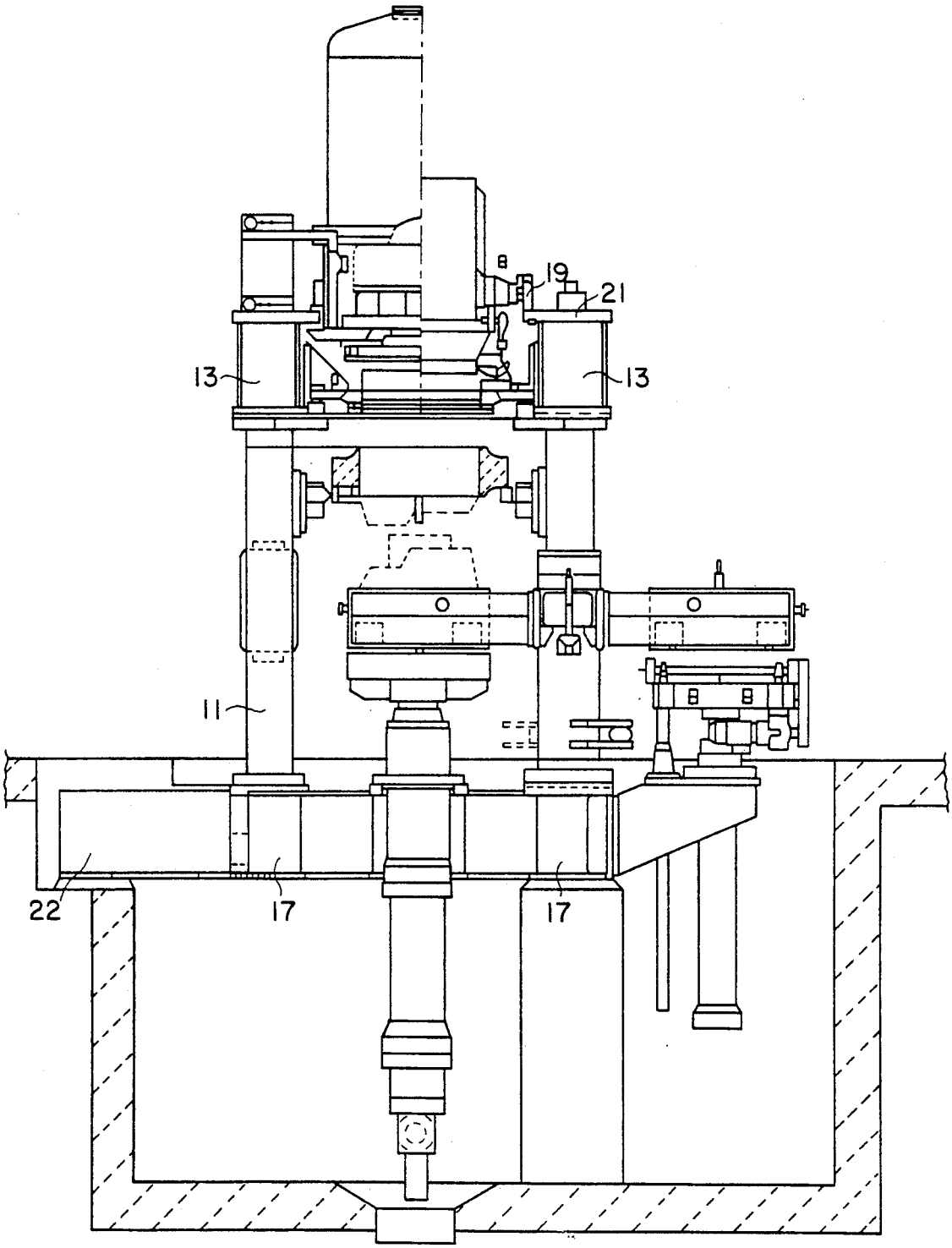
FIG. 2 is another view of the apparatus taken along a section which is at right angles to the section of FIG. 1.

Referring to the drawings, one particular embodiment of the invention is illustrated. In this embodiment, a structural frame 10 is shown comprising columns 11, cross beams 13, 17, and longitudinal beams 22, 23. A forming combination 12 is located within structural frame 10. A filling vessel 14 filled with sand is located above forming combination 12 and travels on casters or wheels 19 along guide rails 21 mounted on the topmost edges of cross beams 13. A pressure vessel 16 is also located above forming combination 12 and travels on casters or wheels 19 along guide rails 21. The pressure vessel 16 is filled with a pressurized gas such as air. By means of a crank 18, the filling vessel 14 and the pressure vessel 16 can be moved along guide rails 21.

Forming combination 12 is known in the art. It comprises a molding box arranged above a model plate with a filling frame resting above it.

In operation, crank 18 is turned so that filling vessel 14 and pressure vessel 16 are displaced along guide rails 21. When filling vessel 14 is located above forming combination 12, sand falls by gravity into the mold box of forming combination 12. Crank 18 is then turned in the opposite direction until pressure vessel 16 is located above forming combination 12. Gas is then released under pressure from pressure vessel 16 and the pressure is applied to the sand in the mold box.

The cross beams 13, 17 and supporting columns 11 of the present structure fulfill multiple functions. They serve, on the one hand, to guide the pressure vessel 16 and the filling vessel 14, they serve as supports, and they are furthermore adapted to take up the stresses of the compressing process and to take up those forces that normally arise due to the back and forth moving parts of the machine.

In prior art devices, the stability of the arrangement has been improved by providing shorter supporting columns 11 while keeping the cross-sections of such columns constant. By means of the present invention, however, the center of gravity is displaced downward to within the range of the forming combination 12. Thus, a new constructive concept is achieved that makes it possible to create changes in construction for a shift to larger forms without incurring any major additional expenses.

Due to the fact that the transverse cross beams 13 that are farthest from the base do not form, as is usual, the top of the apparatus, but are actually arranged in the plane of the bottom opening of the filling vessel 14, it is possible to exchange at any time the pressure vessel or chamber 16, which also is arranged above these cross beams 13, for a bigger one. This may especially be necessary in those cases in which larger forms are desired. In the known machines, where the construction height of the pressure chamber is limited by the topmost transverse cross beam, such an exchange cannot be readily carried out.

The displacement of the center of gravity downwards carries with it a further advantage. Influences of oscillation on the environs are substantially reduced.

This fact results from the correlation that exists between the center of gravity and the theorem of impulse, for the center of gravity will determine that the resting parts must travel a path in reverse direction to the moving parts. By lowering the center of gravity, it is achieved that this path is substantially reduced.

The better space distribution achievable with this apparatus makes it possible to use any desired activation systems for the linear movement of the pressure vessel and filling vessel. Especially by means of crank assembly 18 there may be produced a sinusoidal velocity curve of movement for the moving parts, namely the filling vessel 14 and the pressure vessel 16. They move on casters 19 along guide rails 21 along a portion of the length of the upper beams 13. The purpose of the steady movement by means of the crank assembly 18 is to prevent any pre-compression of the forming substances in the filling vessel 14, which is likely to arise from intermittent movements.

In the illustrated embodiment, guide rails 21, in addition to guiding the movements of filling vessel 14 and pressure vessel 16, also serve as projections on cross beams 13 for receiving the stressing forces necessary for the compression process.

In the illustrated embodiment, it is also desirable that the acting point of the stressing forces comes to lie near the gravity axes of the supporting elements (i.e., within 0–45 cm) so that the distance between the gravity axis and the neutral axis will be as large as possible.

While the invention has been described by reference to specific embodiments, this was for purposes of illustration only and should not be construed to limit the scope of the invention.

What is claimed is:

1. A forming apparatus for the manufacture of casting molds by means of a pressure shock wave from a gaseous medium, comprising, a structural frame, said structural frame comprising columns, upper cross beams and longitudinal beams, a forming combination within said structural frame, means for producing a pressure shock wave located above said forming combination, said means including an enclosed pressure vessel containing a supply of a pressurized gas supported by said upper cross beams of said structural frame, a filling vessel having a bottom opening and being operable for holding sand or another moldable substance for delivery through said bottom opening to said forming combination, said filling vessel being located above said forming combination and supported by said upper cross beams of said structural frame, wherein the topmost edges of said cross beams supporting said filling vessel lie in substantially the same plane as the bottom of said filling vessel, and guide rails connected to said upper cross beams for supporting said filling vessel and said pressure vessel, said filling vessel and said pressure vessel being horizontally displaceable along said guide rails, said structural frame being arranged so that the center of gravity of said structural frame is within said forming combination.

2. The forming apparatus of claim 1 wherein the forming combination comprises a model plate, a molding box arranged above said model plate, and a filling frame arranged above said model plate.

3. The forming apparatus of claim 1 wherein said upper cross beams are provided with at least one projection for receiving the stress forces produced during the manufacture of said cast molds.

4. The forming apparatus of claim 3 wherein said projection for receiving said stress forces also comprises said guide rails.

5. The forming apparatus of claim 3 wherein the acting point of said stress forces lies within about 0–45 cm of the gravity axis of the supporting elements of said structural frame so that the distance between the gravity axis and the neutral axis will be as large as possible.

6. A forming apparatus for the manufacture of casting molds by means of a pressure shock wave from a gaseous medium, comprising a structural frame comprising columns, upper cross beams, and longitudinal beams, a forming combination within said structural frame, means for producing a pressure shock wave located above said forming combination, said means including an enclosed pressure vessel containing a supply of pressurized gas supported by said upper cross beams of said structural frame, a filling vessel having a bottom opening for holding sand or another moldable substance for delivery through said bottom opening to said forming combination, said filling vessel being located above said forming combination and supported by said upper cross beams of said structure frame, guide means connected to said upper cross beams supporting said filling vessel and said pressure vessel, said filling vessel and said pressure vessel being horizontally displaceable along said guide means.

7. The forming apparatus of claim 6 wherein the forming combination comprises a model plate, a molding box arranged above said model plate, and a filling frame arranged above said model plate.

8. The forming apparatus of claim 6 wherein the center of gravity of the structural frame is within the forming combination.

9. The forming apparatus of claim 6 wherein said guide means comprises guide rails.

10. The forming apparatus of claim 9 wherein said upper cross beams are provided with at least one projection for receiving the stress forces produced during the manufacture of cast molds.

11. The forming apparatus of claim 10 wherein said projection itself comprises said guide rails.

12. The forming apparatus of claim 10 wherein the acting point of said stress forces lies within about 0–45 cm of the gravity axis of the supporting elements of said structural frame so that the distance between the gravity axis and the neutral axis will be as large as possible.

* * * * *